US012297698B2

(12) United States Patent
Suresh et al.

(10) Patent No.: US 12,297,698 B2
(45) Date of Patent: May 13, 2025

(54) RETAINER FOR ROTARY CONE DRILL BIT

(71) Applicant: Caterpillar Inc., Peoria, IL (US)

(72) Inventors: Swetha Suresh, Chennai (IN); Ebi Bernard, Arakkonam (IN); Tamilmurasu Annadurai, Pudukkottai (IN); Chetan Dahiwal, Navalleer (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/227,753

(22) Filed: Jul. 28, 2023

(65) Prior Publication Data

US 2025/0034948 A1 Jan. 30, 2025

(51) Int. Cl.
*E21B 10/22* (2006.01)
*E21B 10/24* (2006.01)
*E21B 10/25* (2006.01)

(52) U.S. Cl.
CPC ..... *E21B 10/22* (2013.01); *E21B 10/24* (2013.01); *E21B 10/25* (2013.01)

(58) Field of Classification Search
CPC ..... E21B 10/22; E21B 10/24; E21B 10/25
See application file for complete search history.

(56) References Cited

U.S. PATENT DOCUMENTS 3,363,702 A 1/1968 Bielstein
3,663,073 A 5/1972 Bronson
3,705,750 A 12/1972 Crow
3,950,041 A 4/1976 Miglierini
4,059,316 A 11/1977 Alvarez et al.
4,161,343 A 7/1979 Brashear
4,279,316 A 7/1981 Helmick
4,280,571 A * 7/1981 Fuller ..... E21B 10/24 175/227
4,358,384 A 11/1982 Newcomb
4,598,778 A 7/1986 Highsmith
5,186,267 A 2/1993 White
5,456,327 A 10/1995 Denton et al.
5,668,092 A 9/1997 Denton
6,945,699 B2 9/2005 Tibbits
7,013,998 B2 3/2006 Ray et al.
7,121,365 B2 10/2006 Denton et al.
7,749,947 B2 7/2010 Griffo et al.
8,201,646 B2 6/2012 Vezirian
8,261,841 B2 9/2012 Bailey et al.
8,865,309 B2 10/2014 Setlur et al.
9,228,151 B1 1/2016 Simonetti
(Continued)

FOREIGN PATENT DOCUMENTS

CN 2780972 Y 5/2006
EP 1066447 B1 9/1999
(Continued)

*Primary Examiner* — Yong-Suk (Philip) Ro

(57) ABSTRACT

This disclosure describes, in part, systems and structures for a rotary cone drill bit having a body and rolling cone cutters, wherein the rolling cone cutters are coupled to the body through a bearing retention interface including ball bearings in a captured channel between the body and the rolling cone cutters. The ball bearings are inserted through an opening that is subsequently filled with a retainer pin having an engagement feature that ensures alignment of the retainer pin with respect to the captured channel and the ball bearings to reduce wear within the rotary cone drill bit.

7 Claims, 6 Drawing Sheets

(56) References Cited

U.S. PATENT DOCUMENTS

| | | | | |
|---|---|---|---|---|
| 9,528,066 | B2 | 12/2016 | Sui et al. | |
| 10,119,335 | B2 | 11/2018 | Bomidi et al. | |
| 2002/0108788 | A1* | 8/2002 | Peterson | E21B 10/24 175/371 |
| 2009/0038858 | A1 | 2/2009 | Griffo et al. | |
| 2016/0115739 | A1* | 4/2016 | Nguyen | E21B 10/24 175/228 |
| 2018/0128053 | A1* | 5/2018 | Chiu | E21B 10/22 |
| 2018/0216408 | A1* | 8/2018 | Bomidi | E21B 10/24 |

FOREIGN PATENT DOCUMENTS

| | | | |
|---|---|---|---|
| GB | 2380500 | A | 4/2003 |
| WO | WO1999039075 | | 8/1999 |

* cited by examiner

RETAINER FOR ROTARY CONE DRILL BIT

TECHNICAL FIELD

The present disclosure relates generally to earth boring machines and more particularly to a rotary cone drill bit with an improved retainer system to reduce wear and improve longevity of the drill bit.

BACKGROUND

A rotary cone drill bit is adapted to be connected as the lowest member of a rotary drill string. As the drill string is rotated, the bit disintegrates the earth formations to form an earth borehole. The bit includes individual arms that extend angularly downward from the main body of the bit. The lower end of each arm is shaped to form a journal that may serve as a spindle or bearing pin on which cutting heads rotate. A cone cutter is mounted upon each bearing pin and adapted to rotate thereon. Individual bearing systems promote rotation of the cone cutters. The bearing systems typically include roller bearings, ball bearings, friction bearings and/or a combination of the aforementioned bearings. The cone cutters include cutting structures on their outer surfaces that serve to disintegrate the formations as the bit is rotated.

The rotary cone drill bit operates under very severe conditions, and the size and geometry of the bit is restricted by the operating characteristics. Some means for locking the cone cutter on the bearing pin must be provided. Typically, the locking function has been performed by a ball bearing system although other systems are known. The ball bearing system is used to retain the cone on the bearing journal and may or may not carry axial and radial loads.

An example system for maintaining the cone cutter on the rotary drill bit is described in PCT Patent Publication WO1999039075 to Lada, titled "Rotary Cone Drill Bit Having a Ball Plug Weld with Hardfacing" (hereinafter referred to as the '075 document). In particular, the '075 document describes rotary cone bits with cone cutter assemblies mounted on a spindle projecting from a support arm. Ball bearings are then inserted through an opening or hole in the support arm to rotatably secure the cone cutters to respective spindles. A ball retainer plug is then inserted into the ball retainer passageway and the ball plug weld is formed to secure the ball retainer plug. The '075 document further details hardfacing of metal surfaces to minimize or prevent erosion, such as at the weld surface to ensure the retainer bin remains in position.

Although the apparatus described in the '075 document is configured to retain the ball bearings, and therefore the cone cutter, onto the rotary cone bit assembly, the apparatus and systems described in the '075 document is not able to ensure accurate placement and orientation of the retainer pin during assembly and welding. As a result, the apparatus and systems described in the '075 document is not configured to prevent premature wear on the ball bearings and/or retainer that may result in failure of the rotary cone bit.

Examples of the present disclosure are directed toward overcoming the deficiencies described above.

SUMMARY

One general aspect includes a rotary cone drill bit. The rotary cone drill bit has a bit body having an upper portion adapted for connection to a drill string for rotation of the rotary cone drill bit. The bit also includes one or more support arms attached to and extending from the bit body opposite the upper portion, the one or more support arms each may include a journal having a bearing surface, the journal projecting generally downwardly and inwardly with respect to an associated support arm of the one or more support arms. The bit also includes one or more cutter cone assemblies equal to a number of support arms with each cutter cone assembly respectively rotatably mounted on one of the one or more support arms. The bit also includes an opening formed in an exterior surface of each support arm with a ball retainer passageway extending from the opening in the exterior surface of the support arm where ball bearings may be inserted through the opening and the ball retainer passageway to rotatably secure a respective cutter cone assembly on the journal, the opening may include a first engaging feature. The bit also includes a retainer pin configured to insert into the opening and the ball retainer passageway. The retainer pin has a first end configured to interface with the bearing surface, a second end configured to engage with the opening, where the second end includes a second engaging feature configured to engage with the first engaging feature of the opening to align the retainer pin within the ball retainer passageway.

One general aspect includes a retainer pin for ball bearings of a rotary drill bit. The retainer pin has a first end configured to interface with the ball bearings and includes a first side surface disposed on a first lateral side of the first end, a second side surface disposed on a second lateral side of the first end opposite the first lateral side, a bearing engagement surface disposed at a tip of the first end and having a profile corresponding to a shape of the ball bearings. The retainer pin also includes a second end configured to engage with an opening of a body of the rotary drill bit. The retainer pin also includes an engaging feature configured to align the retainer pin within the opening of the body and relative to a bearing surface that supports the ball bearings.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Wherever possible, the same reference numbers will be used throughout the drawings to refer to the same or like parts. In the figures, the left-most digit(s) of a reference number identifies the figure in which the reference number first appears.

Figure 1:
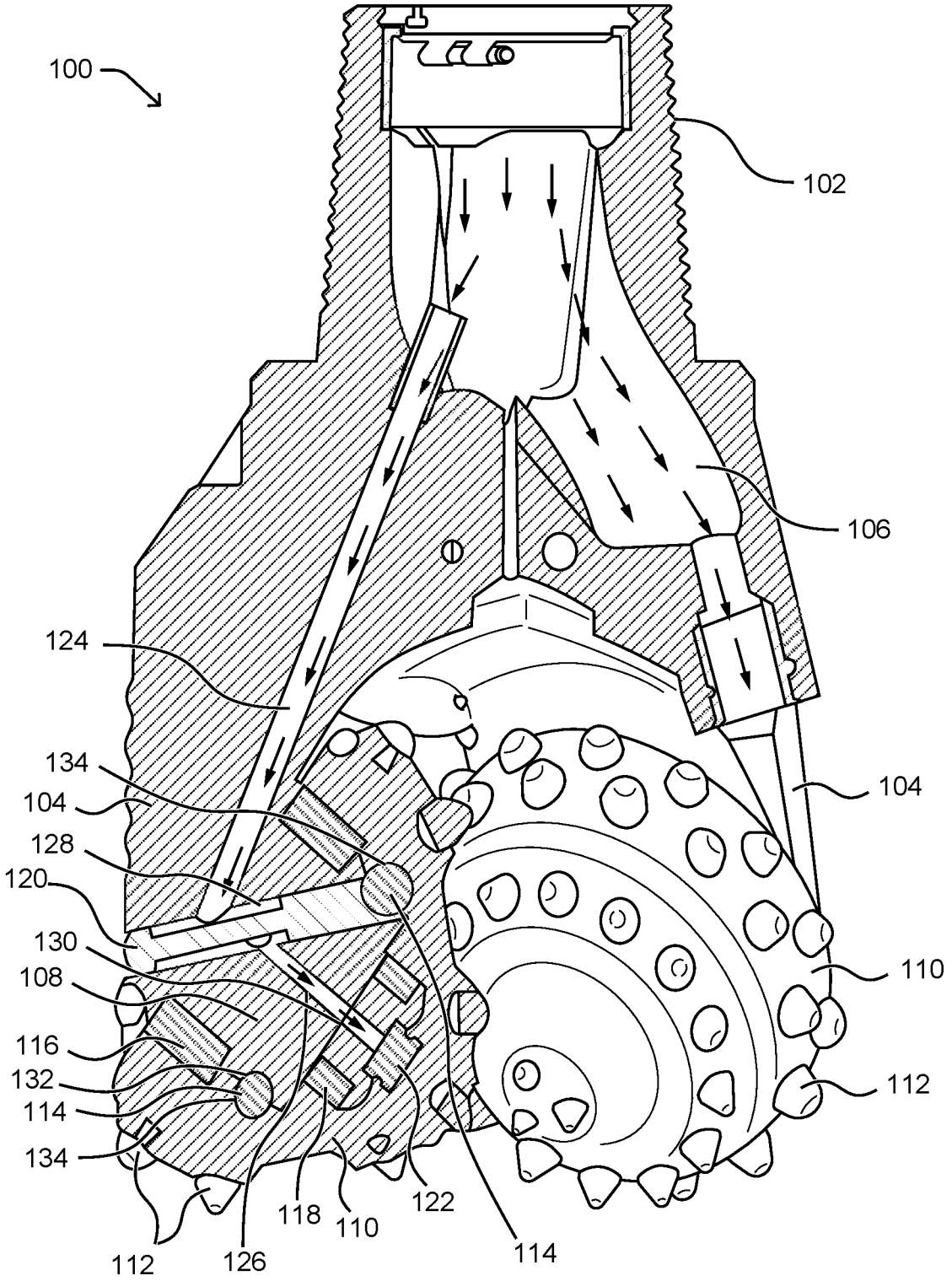
FIG. 1 illustrates a rotary cone drill bit with a retainer pin alignment system, according to at least one example.

FIG. 1 illustrates a rotary cone drill bit 100 with a retainer pin alignment system, according to at least one example. The rotary cone drill bit 100 is formed of a body 102 and one or more support arms 104 that together form a unitary structure. The rotary cone drill bit 100 may also be referred to as a "roller cone rock bit" or "rotary rock bit."

The rotary cone drill bit 100 cuts and drills as cone-shaped cutters, cone cutters 110, are rolled around the bottom of the borehole (not shown) by the rotation of a drill string (not shown) attached to rotary cone drill bit 100 at the body 102. The cone cutters 110 may include a cutting element that is part of the cone, such as milled cutting surfaces and/or embedding cutting inserts. Cone cutters 110 may also be referred to as "rotary cone cutters" or "roller cone cutters." Each cone cutter 110 rotates on respective journal 108, sometimes referred to as a spindle with associated bearings 114, 116, 118, and 122 disposed therebetween. The cone cutter 110 and journal 108 also interact at interface 130 to provide extra load-bearing support to the cone cutter 110 during operation. The rotary cone drill bit 100 comprises a body 102 having a tapered, externally spread upper portion that is adapted to be secured to the lower end of the drill string. Depending from body 102 are three support arms 104 (two visible in FIG. 1). Each support arm 104 includes a cone cutter 110 rotatably mounted on one end, at the journal 108. Each support arm 104 includes a journal 108 formed integral to the support arm 104. Journals 108 are angled downwardly and inwardly with respect to body 102 such that as the rotary cone drill bit 100 is rotated, cone cutters 110 engage the bottom of the borehole (not expressly shown). For some applications, journals 108 may also be tilted at an angle of zero to three or four or more degrees in the direction of rotation of rotary cone drill bit 100.

Cone cutters 110 each may include inserts 112 on the surface thereof which scrape and gouge against the sides and bottom of the borehole under the down-hole force supplied through the drill string to the rotary cone drill bit 100. The inserts 112 may include tungsten carbide inserts that are press-fit into the cone cutters 110. The inserts 112 may also include milled steel inserts to form a cutting surface of the cone cutters 110. The formation of borehole debris thus created is carried away from the bottom of the borehole by a drilling fluid flowing from channels 106 adjacent to lower portions of body 102, such as through channels 124 and 126. The drilling fluid then flows upwardly toward the surface through an annulus (not shown) formed between rotary cone drill bit 100 and the side wall (not shown) of the borehole. Each of the three cone cutters 110 is generally constructed and mounted on its associated journal 108 in a substantially identical manner. Accordingly, only one support arm 104 and cone cutter 110 is described in detail. It should be understood that such description also applies to the other support arms 104 and cone cutters 110.

As shown in FIG. 1, cone cutters 110 have a generally cylindrical internal cavity for receiving journal 108. Bearings 114, 116, 118, and 122 are placed within races and/or bearing surfaces in cone cutters 110 such that the cone cutter 110 may rotate about journal 108. In some examples, one or more seals may be located between the cone cutter 110 and the journal 108 to provide a fluid seal between the internal cavity and the journal 108.

The cone cutter 110 is retained on journal 108 by a plurality of ball bearings 114 inserted through an opening in support arm 104 including a ball passageway 128 in journal 108. Ball bearings 114 reside in an annular array within cooperatively associated ball races in journal 108 and the cone cutter 110. Once inserted, ball bearings 114 prevent the disengagement of the cone cutter from journal 108. Ball passageway 128 is subsequently plugged by inserting retainer pin 120 into ball passageway 128. The retainer pin 120 serves to retain the cone cutter 110 on the journal 108 by retaining the ball bearings 114 in position. The retainer pin 120 may be welded at the opening of the support arm 104 to additionally provide a fluid barrier between the ball passageway 128 and the exterior of the support arm 104. The weld also retains the retainer pin 120 within the ball passageway 128. Welding techniques suitable for use on the rotary cone drill bit 100 include, but are not limited to Gas Metal Arc Welding (GMAW), TIG, Gas Tungsten Arc Welding (GTAW) or "helium arc welding", Shielded Metal Arc Welding (SMAW) or "stick electro welding", Oxy Fuel Welding (OFW), Oxy Fuel Spot Welding (OFSW) and High Velocity Oxy Fuel (HVOF).

The journal 108 of the rotary cone drill bit 100 includes a bearing pin (e.g., bearing) 122 upon which the cone cutter 110 is mounted. The bearing 122 may include a thrust button and may include a first thrust button on the journal 108 with a second thrust button on the cone cutter 110. A plurality of bearing systems are located in the bearing area between the cone cutter 110 and the journal 108. The bearing systems in the bearing area include an outer roller bearing 116, an inner roller bearing 118, and thrust button (e.g., bearing 122). The bearing systems promote rotation of the cone cutter 110 as the bit is rotated by the drill string and moved through the formations in the borehole. An annular groove is provided in the cone cutter 110 for the ball bearings 114. The ball passageway 128 extends from the support arm 104 to a position radially aligned with the groove in the cone cutter 110. The ball passageway 128 allows the ball bearings 114 to be inserted to the annular channels and secure the cone cutter 110 to the journal 108. After the ball bearings 114 are in place, the ball passageway 128 is closed by the retainer pin 120 that is held in position by a weld.

Accordingly, the rotary cone drill bit 100 has a body 102 configured to be rotated about a longitudinal axis and may include at least one support arm 104. The rotary cone drill bit 100 also includes a journal 108 extending from the at least one support arm 104 and defining a first channel 132 around an exterior of the journal 108, and an opening through the journal 108 to the first channel 132 may include a first engaging feature (e.g., the ball bearings 114). The rotary cone drill bit 100 also includes a cone cutter 110 rotatably mounted on the journal 108 and defining a second channel 134 around an interior of the cone cutter 110. The rotary cone drill bit 100 also includes a retention member (e.g., the ball bearings 114) disposed in the first channel 132 and the second channel 134. The rotary cone drill 100 bit also includes a retainer pin 120 configured to insert into the opening, the retainer pin 120 having a first end configured to interface with the first channel 132 and the retention member, a second end opposite the first end configured to engage with the opening, and a second engaging feature configured to engage with the first engaging feature of the opening and configured to align the retainer pin 120 within the opening and relative to the first channel (shown in FIGS. 5-7).

Figure 5:
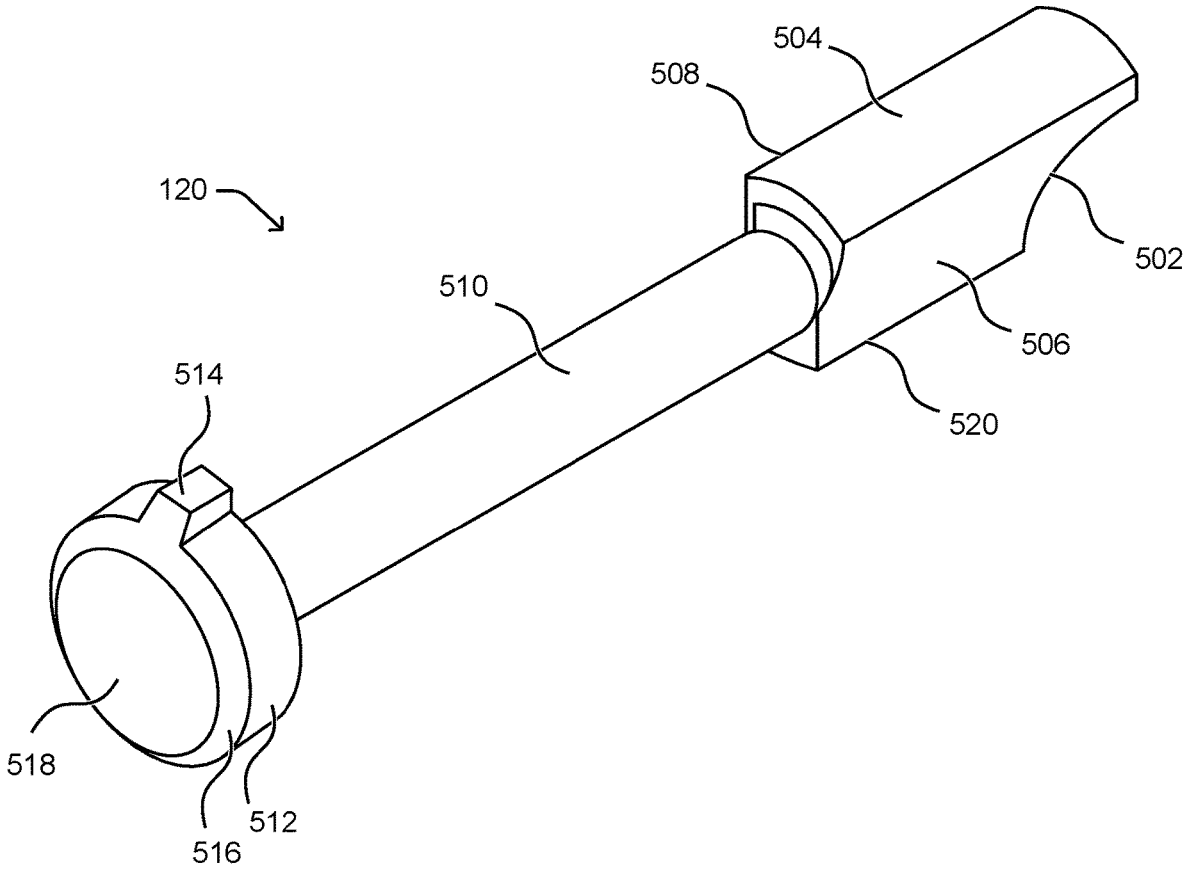
FIG. 5 illustrates a perspective view of a retainer pin with an alignment feature, according to the present disclosure.
Figure 7:
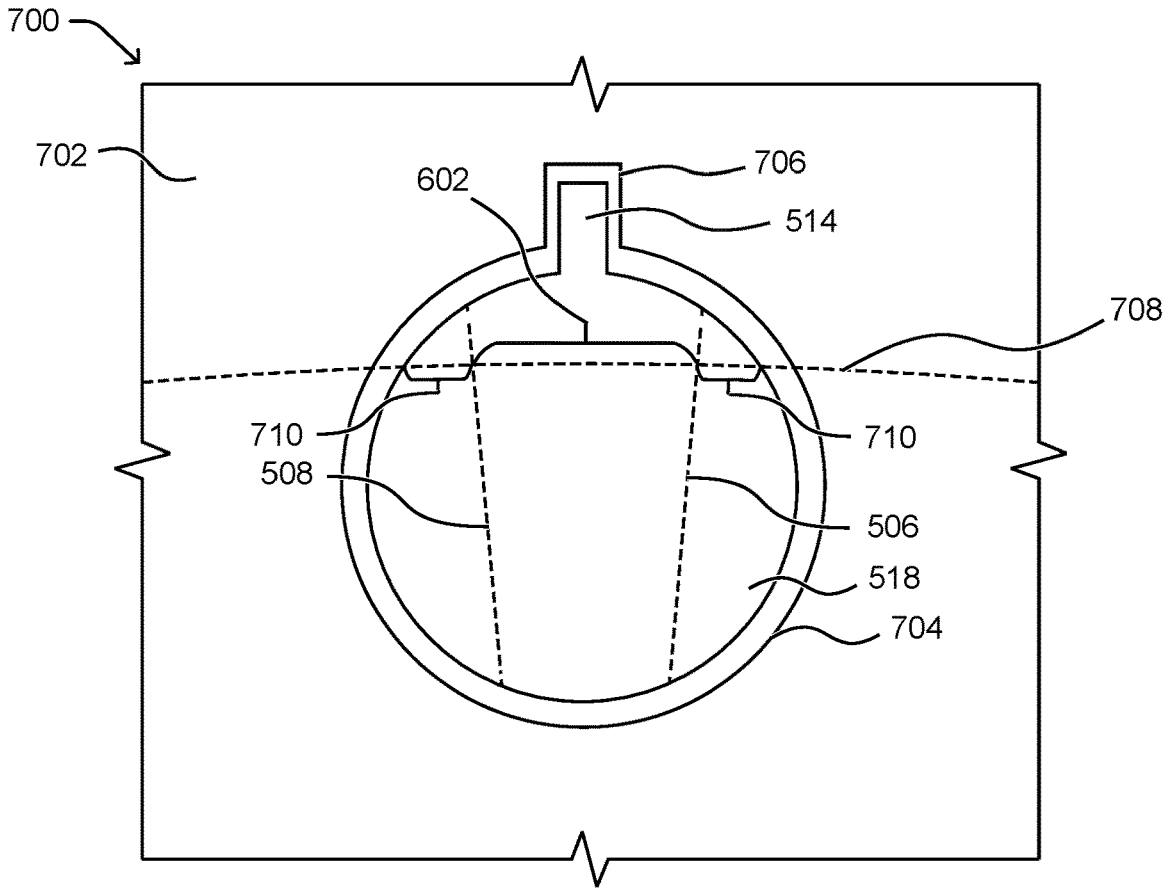
FIG. 7 illustrates a detail view of the retainer pin inserted into a bearing passage of the rotary cone drill bit, according to the present disclosure.

In some examples, the retention member may include ball bearings 114 disposed within a region defined by the first channel 132 and the second channel 134 and where the first end of the retainer pin 120 may include a bearing surface having a profile configured to engage with the ball bearings 114. The profile may include a radial profile extending along a first direction perpendicular to a length of the retainer pin and tangent with the bearing surface when the retainer pin 120 is inserted into the opening (e.g., as illustrated in FIG. 7). The first end may include a first side surface and a second side surface disposed on lateral sides of the retainer pin 120, the first side surface and the second side surface are disposed at a non-zero angle relative to one another. The first end may include a trapezoidal profile defined between the first side surface, the second side surface, an inner edge adjacent an inner diameter of the first channel 132 when the retainer pin 120 is inserted into the opening, and an outer edge adjacent an outer diameter of the first channel 132 when the retainer pin 120 is inserted into the opening. A middle portion of the retainer pin 120, between the first end and the second end, has a first cross-sectional area less than a second cross-sectional area of the first end and a third cross-sectional area of the second end (e.g., as illustrated in FIG. 5). The second engaging feature may include a protrusion and the first engaging feature may include a negative of the protrusion configured to receive the protrusion in a single orientation of the retainer pin 120. The first engaging feature and the second engaging feature define a slot for receiving a key configured to orient the retainer pin 120 in a single orientation when inserted into the opening.

A typical bearing system used to rotatably mount a cone cutter 110 on a journal 108 may include one or more radial bearings and one or more thrust bearings. The radial bearings will generally be located between the outside diameter of the spindle and interior surfaces of the cavity disposed adjacent thereto. Thrust bearings and/or thrust bearing surfaces will generally be located between the end of the journal 108 opposite from the associated support arm 104 and adjacent portions of the cavity formed in the cone cutter 110. For some applications, a shoulder may be formed on the exterior of the journal 108 and a corresponding shoulder formed on the interior of the cavity with a thrust bearing and/or thrust bearing surfaces disposed therebetween.

The thrust bearings and/or the radial bearings may be formed as integral components of the journal 108. For some applications, roller type bearings may be disposed between the outside diameter of the journal 108 and adjacent portions of the cavity to support radial loads transmitted from the cone cutter 110 to the spindle. For other applications, a bushing may be disposed between the outside diameter of the journal 108 and adjacent portions of the cone cutter 110 to carry such radial loads.

The present description particularly relates to the ball bearings 114 bumping into the retainer pin 120 of the rotary cone drill bit 100. Accordingly, the retainer pin 120 includes an engagement feature (not shown in FIG. 1) that ensures that the retainer pin 120 is welded in the intended orientation. This engaging feature and corresponding interlocking or interfacing geometry of the retainer pin 120 and the support arm 104 ensures that the retainer pin 120 is welded in the intended orientation, preventing the ball bearings 114 from bumping into the retainer pin 120 or unevenly wearing it out.

The retainer pin 120 and opening in the support arm 104 includes a slot design to ensure accurate positioning of the retainer pin 120 during assembly of the rotary cone drill bit 100. The slot design ensures that the retainer pin 120 is welded in the intended orientation with the bearing contact surface of the retainer pin 120 properly aligned with the ball bearing races defined by the journal 108 and the cone cutter 110. This engagement feature ensures that the pin is welded in the intended orientation, with the intended orientation ensuring that a ball bearing engaging surface of the retainer pin 120 is correctly positioned and oriented to prevent the ball bearings 114 from bumping into the retainer pin 120 or unevenly wearing it out. The welded retainer pin 120 may subsequently be treated or coated with hardfacing to promote longevity of the rotary cone drill bit 100. Hardfacing of metal surfaces and substrates is a well-known technique to minimize or prevent erosion and abrasion of the metal surface or substrate. Hardfacing can be generally defined as applying a layer of hard, abrasion resistant material to a less resistant surface or substrate by plating, welding, spraying or other well-known metal deposition techniques. Hardfacing is frequently used to extend the service life of drill bits and other downhole tools used in the oil and gas industry. Tungsten carbide and its various alloys are some of the more widely used hardfacing materials to protect drill bits and other downhole tools associated with drilling and producing oil and gas wells.

The engagement feature of the retainer pin 120 may include a slot or first engaging feature on the body of the rotary cone drill bit 100 and a corresponding protrusion or second engaging feature that is configured to interface with the first engaging feature (e.g., as shown and described with respect to FIG. 7 herein). The first engaging feature and second engaging feature may have any geometry, shape, or configuration, however the first engaging feature and the second engaging feature only allow the retainer pin 120 to be fully inserted into the ball passageway 128 when properly aligned. Improper alignment results in the retainer pin 120 not being fully seated and protruding out of the ball passageway 128. The slot design of the first engaging feature and second engaging feature or other engagement feature design ensures that the retainer pin 120 is welded in the intended orientation, preventing the ball bearings 114 from bumping into the retainer pin 120 or unevenly wearing it out during use.

The retainer pin 120 may be made of a variety of materials, and may be heat treated across the entire length, or may have varying heat and/or surface treatments for different sections or portions of the retainer pin 120, for example to increase a hardness of the ball bearing engaging surface.

Figure 2:
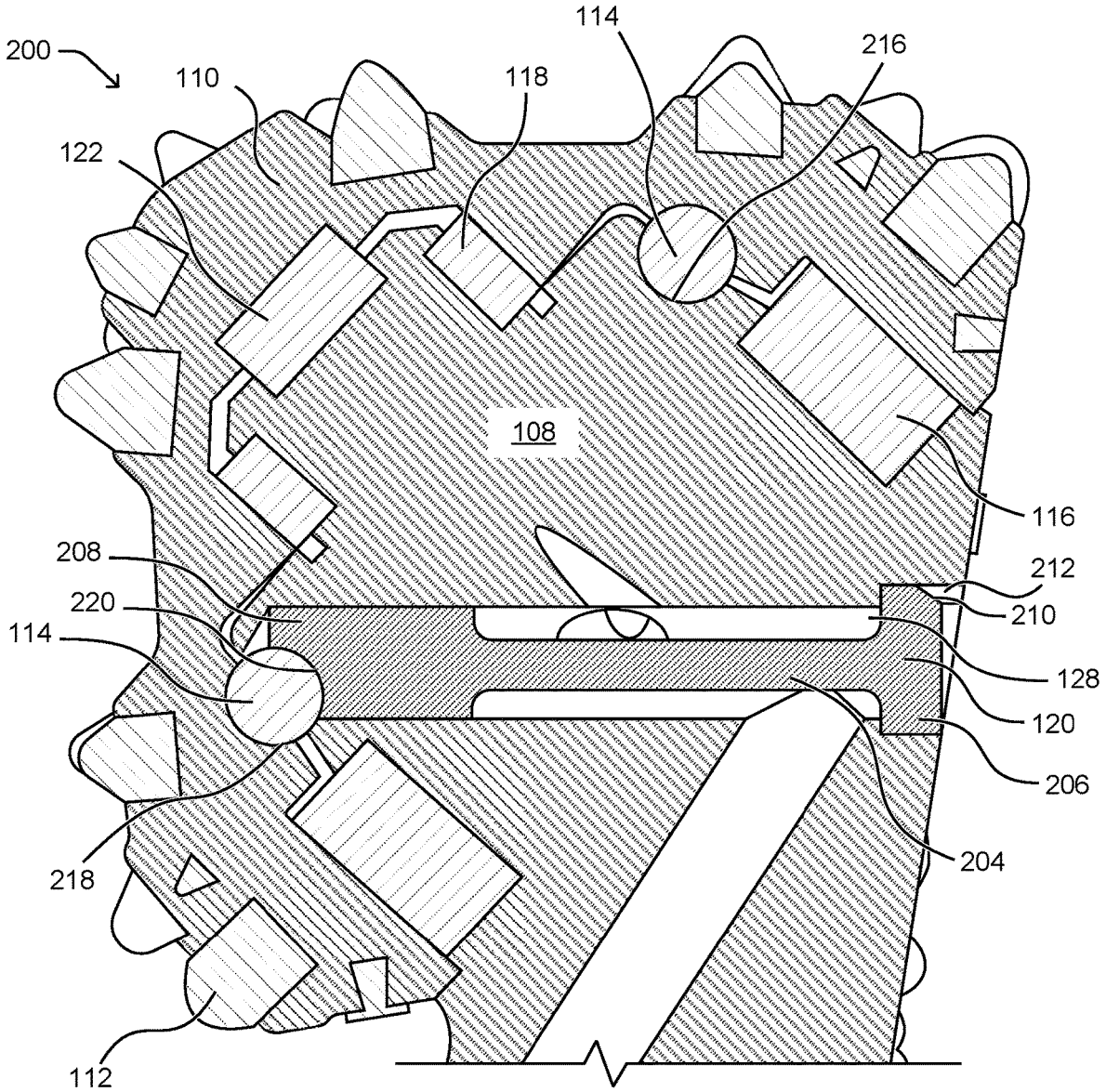
FIG. 2 illustrates a detail section view of the rotary cone drill bit showing the retainer pin with an alignment feature, according to the present disclosure.

FIG. 2 illustrates a detail section view 200 of the rotary cone drill bit 100 showing the retainer pin 120 with an alignment feature (e.g., engaging feature 210), according to the present disclosure. As shown in the detail section view 200, the cone cutter 110 is secured to the journal 108 through the use of ball bearings 114. The ball bearings 114 engage with an inner race 216 (such as an inner bearing race) of the journal 108 and an outer race 218 of the cone cutter 110 to prevent removal of the cone cutter 110 from the journal 108 after assembly.

During assembly of the rotary cone drill bit 100, the cone cutter 110 is positioned over the journal 108 with the bearings 116 and 118 in place between the inner surface of the cone cutter 110 and the outer surface of the journal 108. Additionally, bearing 122 or thrust button may be positioned between the journal 108 and the cone cutter 110. Ball bearings 114 may be inserted through the ball passageway 128 to reach the inner race 216 and the outer race 218. After the ball bearings 114 are inserted through the ball passageway 128, the retainer pin 120 is inserted to prevent the ball bearings 114 from becoming dislodged and thereby allowing the cone cutter 110 to be removed from the journal 108. The retainer pin 120 may be subsequently welded in place to prevent removal from the ball passageway 128.

The retainer pin 120 includes a first end 208, a second end 206, a middle portion 204, and an engagement feature 210.

The first end 208 is configured to interface with the ball bearings 114 through the inner race 216 and the retainer pin 120 may include a first side surface 506 (depicted in FIGS. 5-7) disposed on a first lateral side of the first end 208, a second side surface 508 (depicted in FIGS. 5-7) disposed on a second lateral side of the first end 208 opposite the first lateral side, and a bearing engagement surface that forms a portion of the inner race 216 that may include a profile corresponding to a shape of the ball bearings 114. The bearing engagement surface may be treated with a surface hardening treatment. The first side surface may include a first planar surface and the second side surface may include a second planar surface, and where the first side surface is disposed at a non-zero angle relative to the second side surface. The retainer pin 120 also includes a second end 206 configured to engage with an opening of the body 102 and an engaging feature 210 configured to align the retainer pin 120 within the opening of the body 102 and relative to a bearing surface that supports the ball bearings 114.

The engaging feature 210 may include a second profile configured to engage with the opening of the body in only one orientation to orient the retainer pin relative to the body when inserted in the opening. In some examples, the engaging feature 210 may include a protrusion that acts as a key to orient the retainer pin 120 with respect to the ball passageway 128 such that the bearing engagement surface is oriented tangent with the inner race 216 such that the ball bearings 114 will not collide with the bearing engagement surface and unevenly wear the retainer pin 120. The protrusion may have a particular shape that engages with an engagement feature 212 of the body 102 such that the retainer pin 120 may only be fully inserted when properly aligned. In some examples, the engaging feature may include a protrusion on the body 102 and/or a slot defined between the retainer pin 120 and the ball passageway 128 such that a key may be inserted in the slot when the retainer pin 120 is properly aligned.

The middle portion 204 between the first end 208 and the second end 206, has a first cross-sectional area less than a second cross-sectional area of the first end 208 and a third cross-sectional area of the second end 206. In this manner, the ball passageway may be used as a conduit for fluid, such as are or lubricant, to be channeled through the journal 108 for various purposes such as cooling, dislodging debris, lubrication, etc.

Accordingly, the rotary cone drill bit retention system as described herein includes a body 102 having an upper portion adapted for connection to a drill string for rotation of the rotary cone drill bit 100. The rotary cone drill bit 100 also includes one or more support arms 104 attached to and extending from the body 102 opposite the upper portion, the one or more support arms 104 each include a journal 108 having a bearing surface, the journal 108 projecting generally downwardly and inwardly with respect to an associated support arm of the one or more support arms. The rotary cone drill bit 100 also includes one or more cutter cones 110*s* equal to a number of support arms 104 with each cone cutter 110 respectively rotatably mounted on one of the one or more support arms 104. The rotary cone drill bit 100 also includes an opening formed in an exterior surface of each support arm 104 with a ball passageway 128 extending from the opening in the exterior surface of the support arm 104 where ball bearings 114 may be inserted through the opening and the ball passageway 128 to rotatably secure a respective cone cutter 110 on the journal 108, the opening may include a first profile. The rotary cone drill bit 100 also includes a retainer pin 120 configured to insert into the opening and the ball passageway 128, the retainer pin includes a first end 208 configured to interface with the bearing surface, a second end 206 configured to engage with the opening, and an engaging feature 210 having a second profile configured to engage with the first profile of the opening to align the retainer pin 120 within the ball retainer passageway. In some examples, the depth position of the retainer pin 204 may be set and/or positioned based on the first end 220 engaging with the journal 108 at a bottom of the ball retainer passageway.

In some examples, the engaging feature 210 may include a protrusion having the second profile and the first profile may include a negative or corresponding shape that mates with the second profile. The first end 208 may include a first side surface and a second side surface disposed on lateral sides of the retainer pin, the first side surface and the second side surface may be disposed at a non-zero angle relative to one another. The first end 208 may include a trapezoidal profile defined between the first side surface and the second side surface. The first end 208 may include a contact surface 220, the contact surface 220 having a radial profile extending along a first direction perpendicular to a length of the retainer pin 120 and tangent with the surface (e.g., inner race 216) when the retainer pin 120 is inserted into the opening. The retainer pin 120 may include a hardened surface at the first end 208 for engaging with one or more ball bearings 114 resting within the bearing surface. A middle portion 204 of the retainer pin 120, between the first end 208 and the second end 206, has a first cross-sectional area less than a second cross-sectional area of the first end and a third cross-sectional area of the second end.

Figure 3:
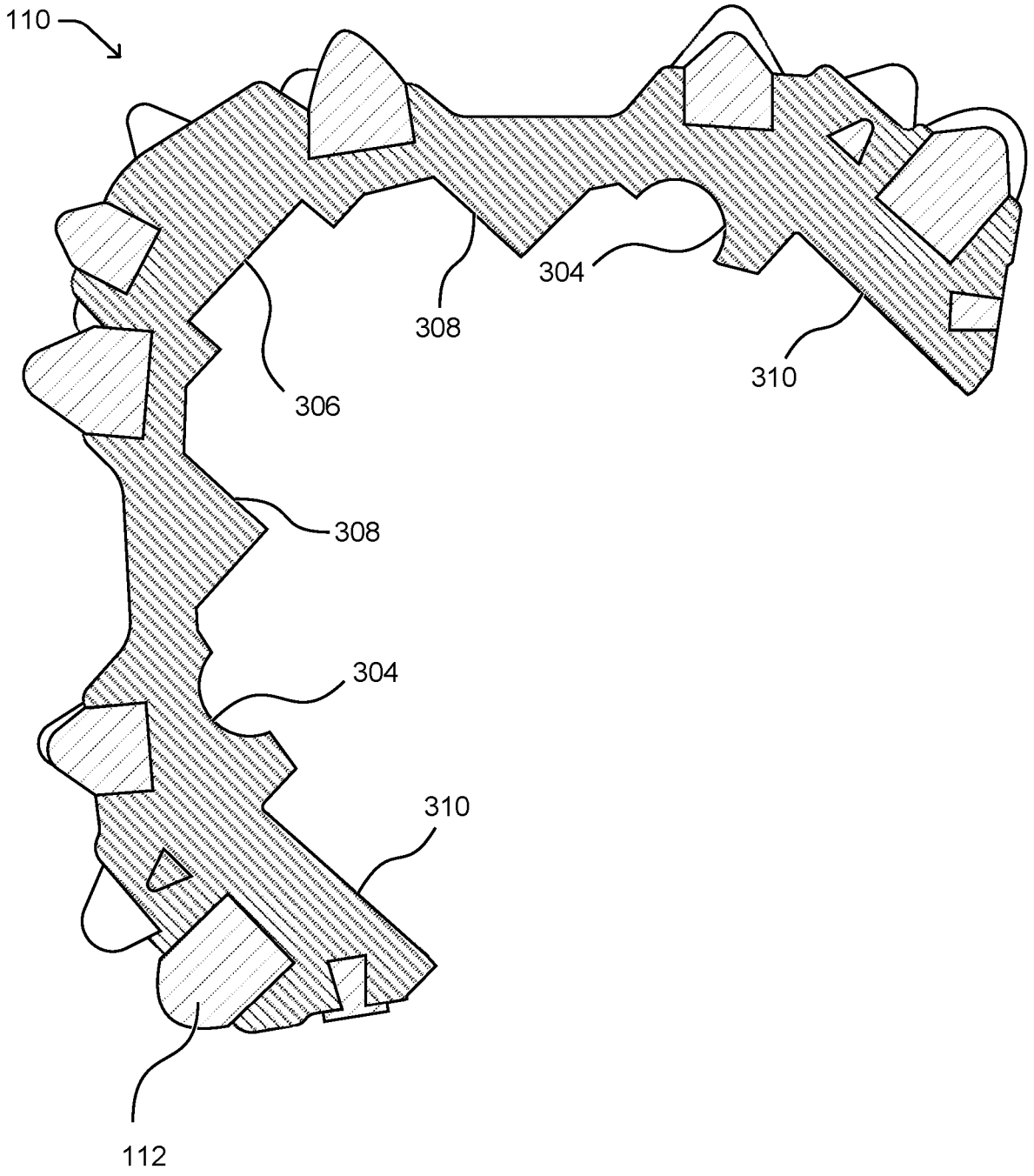
FIG. 3 illustrates a section view of a cone cutter of the rotary cone drill bit, according to the present disclosure.

FIG. 3 illustrates a section view 300 of a cone cutter 110 of the rotary cone drill bit 100, according to the present disclosure. The cone cutter 110 includes bearing surfaces on the interior cavity for receiving the bearings described herein. Bearing surfaces 308 and 310 may be configured to receive roller bearings and bearing surface 306 may be configured for receiving a thrust bearing, bushing, or other such feature. Additional surfaces on the interior of the cone cutter 110 may act as bearing surfaces, including thrust shoulders, additional races, and other features that may be included on the cone cutter 110 and/or journal 108. The surface 304 may form a portion of the bearing race that captures the ball bearings 114 when the rotary cone drill bit 100 is assembled. The surface 304 has a profile (as seen in the cross-section) that corresponds to a shape and size of the ball bearings 114, though in some examples the size may be somewhat larger than the ball bearing diameter. The surface 304 may have a semi-circular shape or have a shape that corresponds to a partial circular cross-section, as illustrated.

Figure 4:
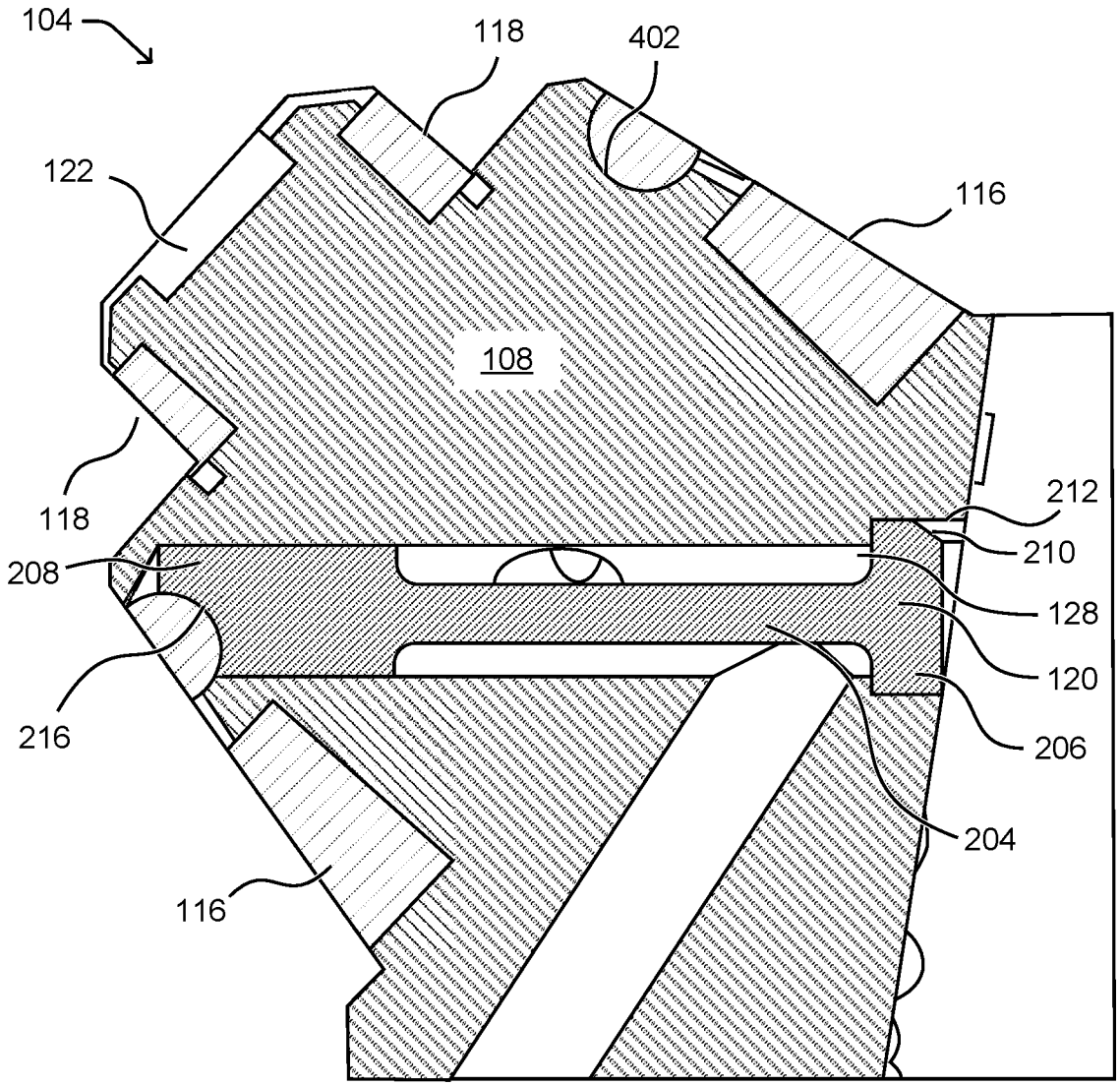
FIG. 4 illustrates a section view of a journal portion of the rotary cone drill bit including the retainer pin with an alignment feature, according to the present disclosure.

FIG. 4 illustrates a section view of a journal 108 of the rotary cone drill bit 100 including the retainer pin 120 with an alignment feature, according to the present disclosure. The journal 108 includes the inner surface 402 that forms the inner portion of the race for the ball bearings 114. The inner surface 402 may have a profile (e.g., a shape, profile, diameter, radius, etc.) similar to that of the surface 304 and together the surface 304 and the inner surface 402 form a channel or race for the ball bearings 114. The inner surface 402 may have a semi-circular cross-section as depicted or other such shape or geometry. The inner surface 402 and/or the surface 304 may be treated with surface treatments, grease, or other components to aid in the rolling action of the ball bearings 114 within the race.

The ball passageway 128 intersects the inner surface 402 such that the inner surface 402 is interrupted at the location of the ball passageway 128. The retainer pin 120, and more particularly, the first end 208 of the retainer pin 120 may fill, partially or entirely, the void in the inner surface 402. In some examples, the inner race 216 may be tangent with the inner surface 402 at the location of the ball passageway 128. For simplicity in machining, the inner race 216 may have a profile that corresponds to the ball bearing 114 (as depicted) but may not follow the curvature of the bearing race. Instead, the bearing surface may be provided to only be tangent with the bearing race. In some examples, the first end 208 and the inner race 216 do not entirely span the gap in the inner surface 402 formed by the ball passageway 128. Instead, the inner race 216 may have a width that is less than the width of the ball passageway, as depicted in FIG. 7.

FIG. 5 illustrates a perspective view of a retainer pin 120 with an engaging feature 514, according to the present disclosure. The retainer pin 120 is configured to insert into an opening in the body of the rotary cone drill bit 100 to retain ball bearings 114 to maintain the cone cutter 110 in position on the journal 108. The retainer pin 120 has a first end 504 that includes a contact surface 502 configured to interface with a bearing race where the ball bearings 114 ride. The retainer pin 120 also include, a second end 512 opposite the first end configured to engage with a distal end of the opening in the body. The second end 512 includes an engaging feature 514 configured to engage with an engaging feature of the opening and/or of the body/journal and configured to align the retainer pin 120 within the opening and relative to the bearing race.

The bearing surface has a profile configured to engage with the ball bearings 114. The profile may include a radial profile extending along a first direction perpendicular to a length of the retainer pin and tangent with the bearing surface when the retainer pin 120 is inserted into the opening. For simplicity in machining, the contact surface 502 may have a profile that corresponds to the ball bearing 114 (as depicted) but may not follow the curvature of the bearing race. Instead, the contact surface 502 may be provided to only be tangent with the bearing race and therefore is perpendicular to a direction along a length of the retainer pin 120 from the first end to the second end.

Figure 6:
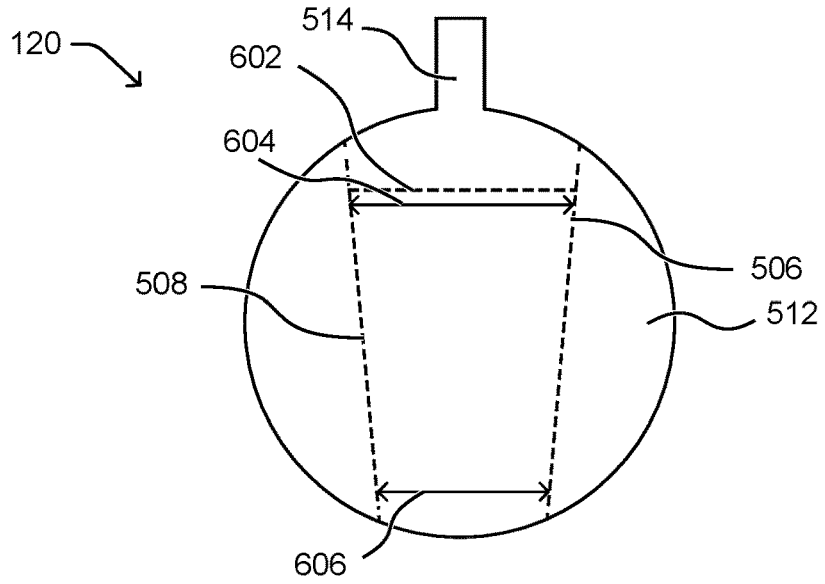
FIG. 6 illustrates an end view of the retainer pin described herein showing a bearing race portion and alignment feature, according to the present disclosure.

The first end 504 may include a first side surface 506 and a second side surface (depicted in FIGS. 6-7) disposed on lateral sides of the first end 504 of the retainer pin 120, the first side surface 506 and the second side surface are disposed at a non-zero angle relative to one another. Accordingly, the first end 504 may include a trapezoidal profile defined between the first side surface 506 and the second side surface 508 as illustrated in FIG. 6.

A middle portion 510 of the retainer pin 120, between the first end 504 and the second end 512, has a first cross-sectional area less than a second cross-sectional area of the first end 504 and a third cross-sectional area of the second end 512. In this manner, the ball passageway may be used as a conduit for fluid, such as are or lubricant, to be channeled through the journal for various purposes such as cooling, dislodging debris, lubrication, etc. as the fluid may flow around the middle portion 510 of the retainer pin 120.

The engaging feature 514 may include a protrusion that engages with a slot or a negative of the protrusion positioned and/or defined in the opening of the body and configured to receive the protrusion in a single orientation of the retainer pin 120. The engaging feature 514 may ensure that the retainer pin 120 is welded in the intended orientation. This engaging feature and corresponding interlocking or interfacing geometry of the retainer pin 120 and the support arm 104 ensures that the retainer pin 120 is welded in the intended orientation, preventing the ball bearings 114 from bumping into the retainer pin 120 or unevenly wearing it out. In some examples, rather than a protrusion, the engaging feature may include a slot that engages with a protrusion defined in the opening. In some examples, the engaging feature may include a slot on the retainer pin 120 and a slot defined in a perimeter of the opening for receiving a key configured to orient the retainer pin 120 in a single orientation when inserted into the opening.

The engaging feature 514 and the corresponding shape or receiving shape of the engaging feature 514 may also be used for setting and ensuring proper depth placement of the retainer pin 120 within the ball passageway. The engaging feature 514 may fit within a slot or groove machined at the perimeter of the opening in the ball passageway. The slot or groove may be machined at a depth such that when the retainer pin 120 is inserted in the ball passageway, the retainer pin 120 is set at the correct depth when the engaging feature 514 bottoms out in the slot or groove. In this manner, the retainer pin 120 may easily be oriented and correctly positioned with respect to depth in the ball passageway without requiring any careful measurements or fixturing, ensuring accurate placement of the retainer pin to promote longevity and reduce wear at the retainer pin that may result in early failure of the rotary cone drill bit.

At the second end 512, the retainer pin 120 includes a chamfered edge 516 and an outer surface 518. The chamfered edge 516 may be used when welding the retainer pin 120 to the body of the rotary cone drill bit. The chamfered edge allows for the weld to fill the space allotted by the chamfer between the retainer pin 120 and the opening.

FIG. 6 illustrates an end view of the retainer pin 120 described herein showing a bearing race portion and alignment feature, according to the present disclosure. The engagement feature 514 is shown protruding such that when inserted into an opening, the engaging feature 514 will only allow the retainer pin 120 to be fully inserted when correctly oriented. The side surfaces of the first end are depicted, with the first side surface 506 and the second side surface 508 forming a trapezoidal profile as described herein. The distance 606 between the first side surface 506 and second side surface 508 at a bottom edge of the trapezoid (e.g., adjacent the distance 606 in FIG. 6) may correspond to an inner diameter and/or be adjacent an inner diameter of the inner race 216 and is less than the distance 604. The contact surface 602 may curve from the edge shown at 602 in FIG. 6 towards the bottom (as illustrated) adjacent the narrow portion of the trapezoid.

The retainer pin 120, and more particularly, the first end of the retainer pin 120 may fill, partially or entirely, the void in the bearing race as described herein. In some examples, the contact surface 602 may be tangent with the bearing race at the location of the ball passageway 128. For simplicity in machining, the contact surface 602 may have a profile that corresponds to the ball bearing 114 (as depicted) but may not follow the curvature of the bearing race. Instead, the contact surface 602 may be provided to only be tangent with the bearing race (and is therefore illustrated as flat across the upper edge at 602). In some examples, the first end and the contact surface 602 do not entirely span the gap in the bearing race formed by the ball passageway. This may enable the use of the simplified profile at the first end and may also enable air or fluid to blow along the ball passageway into the space between the journal and the cone cutter.

FIG. 7 illustrates a detail view 700 of the retainer pin 120 inserted into a bearing passage of the rotary cone drill bit, according to the present disclosure. Only a portion of the body 702 is shown in FIG. 7. The portion of the body includes the opening 704 that leads to the ball passageway 128 as described herein. The opening 704 is defined in the body 702 with an engagement feature 706 that corresponds to the profile of the engagement feature 514 of the retainer pin 120. Though a particular shape and geometry for the engaging features is shown in FIG. 7, other shapes and geometries are envisioned that enable the retainer pin 120 to be inserted into the opening 704 fully only when properly oriented.

As described above, the bearing race 708 is defined within the journal with a gap in the surface of the bearing race 708 where the ball passageway 128 intersects. The width of the contact surface 602 of the retainer pin 120 is less than the width of the void in the bearing race 708. Accordingly, space 710, is left on either side of the contact surface 602. This space accommodates the flat profile of the contact surface 602 (e.g., flat indicative of being tangent to the bearing race 708 rather than having a matching curvature) as described herein. In some examples, the retainer pin 120 may have a curved bearing surface that follows the curvature of the bearing race 708.

INDUSTRIAL APPLICABILITY

The present disclosure provides systems and methods for securing cone cutters journals of rotary cone drill bits, and particularly to retainer pins and retainer pin geometry to enable accurate depth and positioning and rotational orientation of the retainer pin with respect to the ball bearings used for maintaining engagement between the cone cutter and the journal. The retainer pin includes geometry for an engaging slot and protrusion that engage only when properly oriented and also provide accurate depth positioning of the retainer pin. Such systems and methods may be used to achieve better performance and longevity for one or more machine operations by reducing wear and increasing lifetime of rotary cone drill bits, thereby reducing downtime and costs associated with repairs and replacement of drill bits. Thus, the example systems and methods described above can provide considerable cost and time savings and reduce the time and labor required for various activities at the worksite among other things that become apparent to one skilled in the art.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A rotary cone drill bit comprising:

a bit body having an upper portion adapted for connection to a drill string for rotation of the rotary cone drill bit;

one or more support arms attached to and extending from the bit body opposite the upper portion, each of the one or more support arms comprising a journal having a first bearing surface, the journal projecting generally downwardly and inwardly with respect to an associated support arm of the one or more support arms;

one or more cutter cone assemblies equal to a number of support arms with each cutter cone assembly respectively rotatably mounted on one of the one or more support arms;

an opening formed in an exterior surface of each support arm with a ball retainer passageway extending from the opening in the exterior surface of the support arm wherein the opening and the ball retainer passageway are configured to receive whereby ball bearings, the ball bearings configured to rotatably secure a respective cutter cone assembly on the journal, the opening defining a first engaging feature in a perimeter of the opening; and a retainer pin configured to insert into the opening and the ball retainer passageway, the retainer pin comprising:

a first end having a contact surface configured to interface with the bearing surface of the journal; and a second end having a cylindrical shape and configured to fit within the opening, wherein the second end comprises a second engaging feature comprising a protrusion extending from a perimeter of the cylindrical shape configured to engage with the first engaging feature of the opening to align the retainer pin within the ball retainer passageway such that the contact surface is tangent to the bearing surface of the journal.

2. The rotary cone drill bit of claim 1, wherein the second engaging feature comprises a rectangular protrusion and the first engaging feature is onfigured shaped to receive the rectangular protrusion in a single orientation of the retainer pin.

3. The rotary cone drill bit of claim 1, wherein the first end comprises a first side surface and a second side surface disposed on lateral sides of the retainer pin, the first side surface and the second side surface are disposed at a non-zero angle relative to one another.

4. The rotary cone drill bit of claim 1, wherein the first engaging feature comprises a first geometric shape defined by the opening and the second engaging feature comprises a second geometric shape forming the protrusion configured to fit within the first geometric shape.

5. The rotary cone drill bit of claim 1, wherein the first end comprises a second bearing surface, the second bearing surface having a radial profile extending along a first direction perpendicular to a length of the retainer pin and tangent with the first bearing surface.

6. The rotary cone drill bit of claim 1, wherein the retainer pin comprises a hardened surface at the first end for engaging with one or more ball bearings resting within the bearing surface.

7. The rotary cone drill bit of claim 1, wherein a middle portion of the retainer pin, between the first end and the second end, has a first cross-sectional area less than a second cross-sectional area of the first end and a third cross-sectional area of the second end.

* * * * *